US005769407A

United States Patent [19]

Hansen

[11] Patent Number: 5,769,407

[45] Date of Patent: Jun. 23, 1998

[54] MISFEED DETECTOR WITH VOLTAGE RESPONSE ADJUSTMENT

[75] Inventor: Paul Hansen, Westminster, Calif.

[73] Assignee: Xerox Corporation, Stamford, Conn.

[21] Appl. No.: 782,325

[22] Filed: Jan. 13, 1997

[51] Int. Cl.[6] ..... B65H 5/22

[52] U.S. Cl. ..... 271/3.03; 271/3.13; 271/9.01; 271/9.13; 271/263; 271/265.04

[58] Field of Search ..... 271/3.03, 3.13, 271/9.01, 9.13, 263, 259, 265.04, 265.02

[56] References Cited

U.S. PATENT DOCUMENTS

| | | | |
|---|---|---|---|
| 5,105,073 | 4/1992 | Nochise et al. | 271/263 |
| 5,503,382 | 4/1996 | Hansen et al. | 271/3.03 |
| 5,584,472 | 12/1996 | Hidding et al. | 271/3.03 |
| 5,586,755 | 12/1996 | Hansen et al. | 271/3.03 |

*Primary Examiner*—H. Grant Skaggs
*Attorney, Agent, or Firm*—Sheldon Raizes

[57] ABSTRACT

A sheet feed sensor is designed to have a first given voltage response condition for sensing sheets within a first range of paper weight values and a second given voltage response condition for sensing sheets within a second range of paper weight values. A current value supplied to the emitter of the sensor can be controlled to provide the desired voltage response or a resistance in a phototransistor collector circuit can be varied to provide the desired voltage response condition. If the first range of paper weight values is lighter than the second range of paper weight values, the sensor, when in the first given voltage response condition, will have a voltage response, when sensing a sheet of a given paper weight, which is higher than the voltage response when the same sensor senses a sheet of the same paper weight, when the sensor is in the second given voltage response condition. This way the difference between a voltage response at the phototransistor for a single sheet and a voltage response for two sheets, each of the same paper weight as the single sheet, fed through the sensor is large enough throughout all paper weight ranges to obviate the possibility of voltage response overlap.

20 Claims, 8 Drawing Sheets

MISFEED DETECTOR WITH VOLTAGE RESPONSE ADJUSTMENT

This application is related to copending U.S. application Ser. No. 08/782,323 entitled Single Tray and Multi Tray Misfeed Detector with Voltage Response Adjustment, filed concurrently herewith, and U.S. application Ser. No. 08/782,324 entitled Multi Tray and Buffer Tray Misfeed Detector with Voltage Response Adjustment, filed concurrently herewith. Each of these applications is assigned to the assignee of this application.

BACKGROUND

This invention relates to a system for detecting a multi-sheet feed from an intermediate stacker or buffer tray containing a stack of different weight sheets.

It is common to employ with laser printers, a multi-tray sheet feeder with an intermediate stacker. The sheets in each tray are of the same thickness, but the sheets in one tray may be of a different thickness than the sheets in another tray. The sheets are fed from each sheet feeder tray to the intermediate stacker and then to the printer. The sheets in the intermediate stacker will be of varying thicknesses if the sheets in one tray are of a different thickness than the sheets in another tray. It is important that only one sheet at a time be fed from the intermediate stacker and if more than one sheet is fed from the stacker, that it be detected immediately and the system can be either shut down to correct the situation or the offending sheets be sent to a purge tray at the printer without shutting down the system. Each sheet fed from a tray is sensed by an inlet sensor just prior to the sheet entering into the intermediate stacker and each sheet fed from the stacker is sensed by an outlet sensor and the thickness value sensed by the outlet sensor is compared to the thickness value for the same sheet that was sensed by the inlet sensor. If the thickness values match, then only one sheet has been fed from a tray or the intermediate stacker. If the thickness value is more that the thickness value in memory, then that indicates that more than one sheet has just left the tray.

The sensor comprises an emitter and a phototransistor between which the sheets of paper pass. The emitter emits rays through the sheets of paper that are sensed by the phototransistor. It is common to supply a given fixed current to the emitter when sensing sheets passing through the sensor even though the sheets sensed may vary significantly in paper weight. This causes a problem at certain paper weights since the difference between voltage response at the phototransistor for a single sheet and the voltage response for two sheets, each of the same paper weight as the single sheet, fed through the sensor can be small enough that the voltage responses can overlap due to imperfections in the paper, images that are on preprinted paper, misalignment between the emitter and phototransistor, and response variations between different phototransistors. This could cause false detections of double fed sheets.

Therefore, it is an object of this invention to provide the above described system with a large enough difference between the voltage response at the phototransistor for a single sheet and the voltage response for two sheets, each of the same paper weight as the single sheet, fed through the sensors to avoid any overlap due to imperfections in the paper, images that are on preprinted paper, misalignment between the emitter and phototransistor, and response variations between different phototransistors.

SUMMARY OF INVENTION

In accordance with this invention, a sensor is designed to have a first given voltage response condition for sensing sheets within a first range of paper weight values and a second given voltage response condition for sensing sheets within a second range of paper weight values. A current value supplied to the emitter of the sensor can be controlled to provide the desired voltage response or a resistance in a phototransistor collector circuit can be varied to provide the desired voltage response condition. If the first range of paper weight values is lighter than the second range of paper weight values, the sensor, when in the first given voltage response condition, will have a voltage response, when sensing a sheet of a given paper weight, which is higher than the voltage response when the same sensor senses a sheet of the same paper weight, when the sensor is in the second given voltage response condition. This way the difference between a voltage response at the phototransistor for a single sheet and a voltage response for two sheets, each of the same paper weight as the single sheet, fed through the sensor is large enough throughout all paper weight ranges to obviate the possibility of voltage response overlap.

A system employing this invention comprises a laser printer, a multi-tray sheet feeder and an intermediate stacker. The sheets in each tray are of the same thickness, but the sheets in one tray may be of a different thickness than the sheets in another tray. The sheets are fed from each sheet feeder tray to the intermediate stacker and then to the printer. A preliminary sensor is provided near the trays and an inlet sensor is provided just prior to entry of a sheet into the intermediate stacker and an outlet sensor is provided to sense a sheet as it is fed from the intermediate stacker.

The preliminary sensor senses the paper weight of a sheet as it is fed from a tray toward the intermediate stacker. A proper current value or resistance value corresponding to the paper weight of a sheet sensed by the preliminary sensor is supplied to the inlet sensor to sense the thickness of the same sheet. A proper current value or resistance value, which corresponds to the paper weight of such sheet, to be supplied to the outlet sensor is placed in memory for that particular sheet. The current value or resistance value in memory for the outlet sensor is supplied to the outlet sensor to sense the thickness of the same sheet as it is fed from the intermediate stacker and that thickness value is compared with the thickness value, in memory, sensed of the same sheet by the inlet sensor to detect a multi sheet feed from the intermediate stacker.

In accordance with another embodiment of this invention, a single tray carries a stack of sheets. If the paper weight of sheets of paper on the tray fall within the first range of paper weight values, a sensor which senses the sheets fed from the tray is in the first given voltage response condition and if the paper weight of the sheets falls within the second range of paper weight values the sensor is in the second given voltage response condition. A voltage response value sensed by the sensor of the first sheet fed from the tray is stored in memory as the voltage response value for all sheets on the tray. The voltage response value sensed by the same sensor of subsequent sheets fed from the tray is compared with the voltage response value in memory to detect a multi sheet feed from the tray.

DETAILED DESCRIPTION OF THE INVENTION

Figure 1:
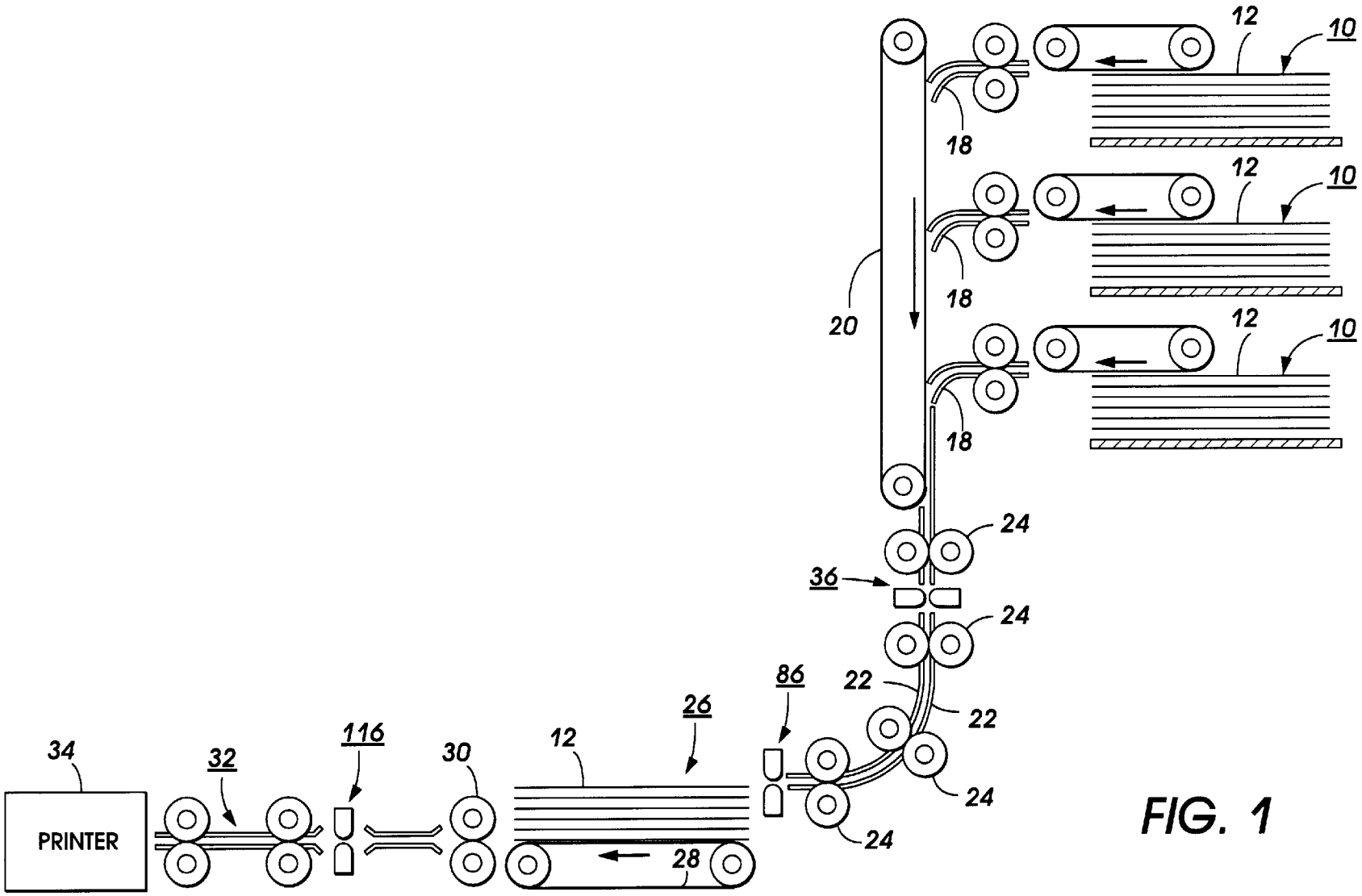
FIG. 1 is a schematic view of a multi-tray printing system which includes an intermediate or buffer sheet tray.

Referring to FIG. 1, there is shown a printing system comprising three feed trays 10, each having a plurality of sheets 12 stacked therein. The sheets in each tray are of the same thickness as the others in the same tray, but are of a different thickness than the sheets in the other trays. A sheet feeding apparatus 18 is provided for each feed tray and a common vacuum sheet transport belt conveyor 20 transports a sheet to guides 22 where a plurality of driven nip rolls 24 move a sheet through the guides to an intermediate stacker 26. Sheets are bottom fed from the stacker 26 by a vacuum transport belt 28 to nip rolls 30 which move the sheets to a printer entry transport 32 from which the sheets enter a laser printer 34 where an image is transferred to each sheet.

Figure 2:
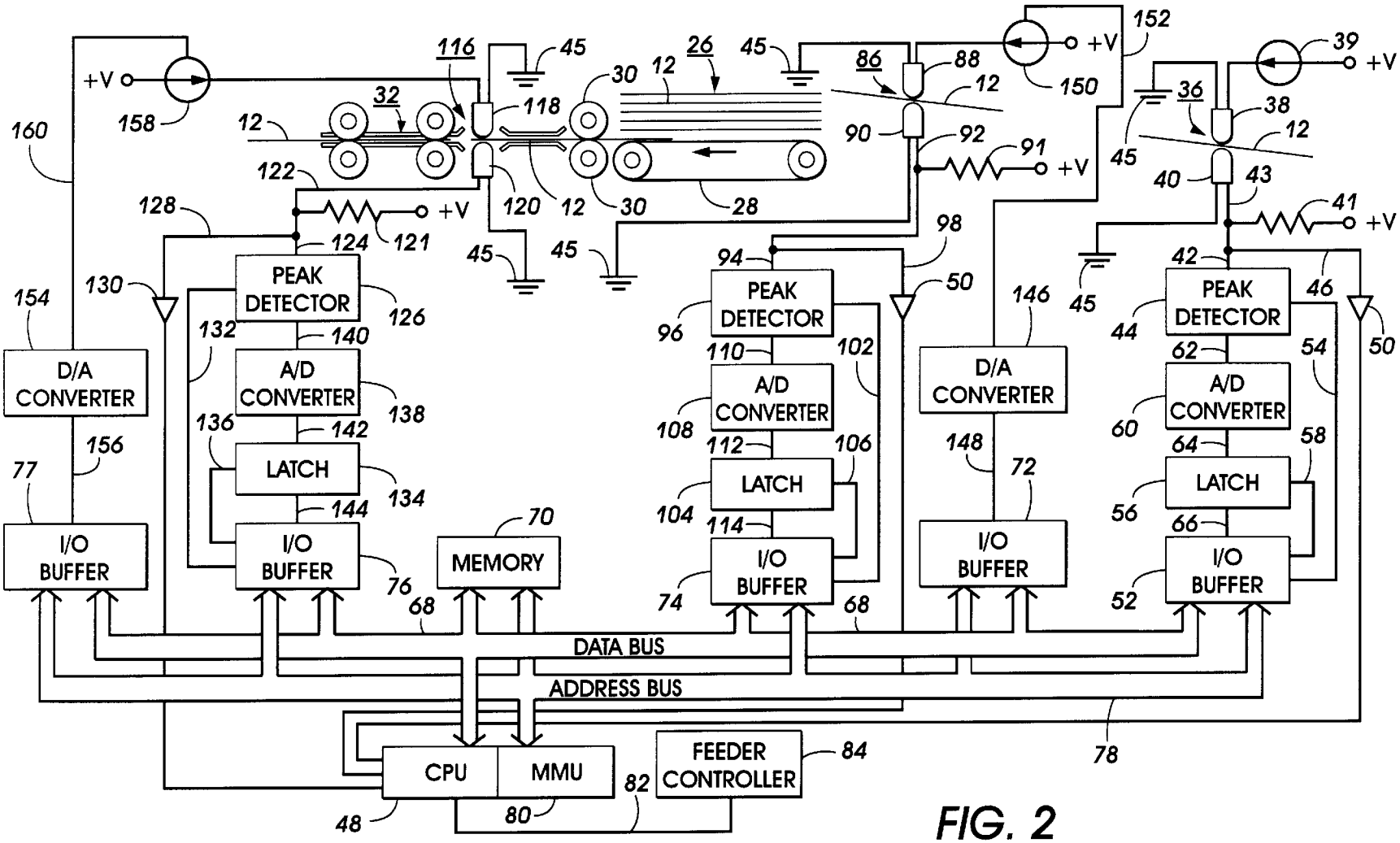
FIG. 2 is a block schematic diagram of a multi-sheet feed detector operating system embodying this invention for the printing system illustrated in FIG. 1.

Referring to FIG. 2, there is shown the intermediate sheet stacker 26 and a sheet thickness sensing arrangement A preliminary inlet sensor 36 is provided at the guides 22 and comprises an infrared emitter 38 and a phototransistor 40. Any type of emitter can be used, but infrared is preferred. A current source 39 is connected to emitter 38 to supply a desired current value to the emitter 38. The collector 43 of the phototransistor 40 is connected through a control line 42 to a peak detector 44 and through control line 46 to a CPU (central processing unit) 48. A positive transition detector 50 is located in control line 46 between the phototransistor 40 and the CPU 48 and detects sudden voltage changes at the collector 43. The peak detector 44 detects a peak voltage at collector 43 and is connected to an I/O (Input/output) buffer 52 through a control line 54 to allow the CPU to reset the peak detector to zero. A latch 56 is connected to the I/O buffer 52 through a control line 58 to allow the CPU to implement a data latch function. An A/D (analog/digital) converter 60 is connected to the peak detector 44 by data line 62 and to the latch 56 by a data line 64. A data line 66 connects the latch 56 to the I/O buffer 52. A data bus 68 links the CPU 48 with the I/O buffer 52, memory 70 and four other I/O buffers 72, 74, 76 and 77. The memory 70 is a two part memory having a RAM and an EPROM. An address bus 78 links a MMU (memory management unit) 80 with the I/O buffers 52, 72, 74, 76 and 77 and the memory 70. The CPU 48 is connected through a control line 82 to a feeder controller 84 for controlling feeding of the sheets from the trays 10 and into and out of the intermediate stacker 26.

An inlet sensor 86 is provided at the inlet of the stacker 26 and is spaced from the preliminary inlet sensor 36 by at least the length of a sheet to allow adequate time to obtain the sensing results of the preliminary inlet sensor 36 prior to the sheet entering the inlet sensor 86. The inlet sensor 86 comprises an infrared emitter 88 and a phototransistor 90. The collector 92 of the phototransistor 90 is connected through a control line 94 to a peak detector 96 and through control line 98 to the CPU 48. A positive transition detector 100 is located in control line 98 between the phototransistor 90 and the CPU 48 and detects sudden voltage changes at the collector 92. The peak detector 96 detects a peak voltage at collector 92 and is connected to the I/O (Input/output) buffer 74 through a control line 102 to allow the CPU to reset the peak detector to zero. A latch 104 is connected to the I/O buffer 74 through a control line 106 to allow the CPU to implement a data latch function. An A/D (analog/digital) converter 108 is connected to the peak detector 96 by data line 110 and to the latch 104 by a data line 112. A data line 114 connects the latch 104 to the I/O buffer 74.

At the outlet of the intermediate stacker 26 is an outlet sensor 116 which comprises an infrared emitter 118 and a phototransistor 120 with a collector 122. The collector 122 of the phototransistor 120 is connected through a control line 124 to a peak detector 126 and through control line 128 to the CPU 48. A positive transition detector 130 is located in control line 128 between the phototransistor 120 and the CPU 48 and detects sudden voltage changes at the collector 122. The peak detector 126 detects a peak voltage at collector 122 and is connected to the I/O buffer 76 through a control line 132 to allow the CPU to reset the peak detector to zero. A latch 134 is connected to the I/O buffer 76 through a control line 136 to allow the CPU to implement a data latch function. An A/D converter 138 is connected to the peak detector 126 by data line 140 and to the latch 134 by a data line 142. A data line 144 connects the latch 134 to the I/O buffer 76.

The I/O buffer 72 is connected to a digital to analogue to digital (D/A) converter 146 by a data line 148. The D/A converter 146 is connected to a current source 150 for the emitter 88 by a current control line 152. The CPU 48 addresses the I/O buffer 72 by the address bus 78 and inputs a value of current to the buffer 72 by data bus 68. The buffer 69 inputs that value to the D/A converter 146 over the data line 148 and that value is converted by the D/A converter 146 to an analogue signal that is transmitted to the current source 150 by current control line 152 to supply a given current to the emitter 88.

The I/O buffer 77 is connected to a digital to analogue (D/A) converter 154 by a data line 156. The D/A converter 154 is connected to a current source 158 for the emitter 118 by a current control line 160. The CPU 48 addresses the I/O buffer 77 by the address bus 78 and inputs a value of current to the buffer 77 by data bus 68. The buffer 77 inputs that value to the D/A converter 154 over the data line 156 and that value is converted by the D/A converter 154 to an analogue signal that is transmitted to the current source 158 by current control line 160 to supply a given current to the emitter 118.

The amount of current that flows through the phototransistors 40, 90 and 120 is a function of the amount of light to which a phototransistor is exposed. If the exposure to light is increased, more current will flow and if the exposure to light is decreased, less current will flow. The emitters 38, 88 and 118 each emits rays towards the base of its respective phototransistor 40, 90 and 120 which strike the phototransistors 40, 90, and 120 at maximum intensity when a sheet of paper is not between the emitter and its respective phototransistor. Therefore, there is maximum current flow across a resistor 41 when a sheet of paper is not between emitter 38 and its respective phototransistor 40 and the voltage difference between ground 45 and the collector 43 of the phototransistor 40 is at its lowest value in this condition. It also follows that there is maximum current flow across a resistor 91 when a sheet of paper is not between emitter 88 and its respective phototransistor 90 and the voltage difference between ground 45 and the collector 92 of the phototransistor 90 is at its lowest value in this condition. Furthermore, there is maximum current flow across a resistor 121 when a sheet of paper is not between emitter 118 and its respective phototransistor 120 and the voltage difference between ground 45 and the collector 122 of the phototransistor 120 is at its lowest value in this condition.

When a sheet of paper passes between the emitter 38 and the phototransistor 40, light from the emitter will pass through the sheet of paper with the amount of light passing through being dependent upon the thickness of the paper. More light will pass through a thin sheet than a thick sheet. Since the phototransistor 40 is exposed to less light when a sheet of paper is passing between the emitter 38 and the phototransistor 40, less current flows through resistor 41 and the voltage difference between the collector 43 and ground 45 increases. The voltage difference between ground 45 and the collector 43 will increase in accordance with an increase in the thickness of a sheet since the amount of light to which the phototransistor 40 is exposed decreases as the thickness of a sheet sensed increases. This principle also applies when a sheet of paper passes between the emitter 88 and the phototransistor 90 and between emitter 118 and phototransistor 120 and therefore the voltage difference between ground 45 and the collectors 92 and 122 will increase in accordance with an increase in the thickness of a sheet.

There is a problem with measuring the flow of light through the sheets of paper. If the voltage difference between the voltage response of the phototransistors 40, 90, 120 to light passing through one sheet of paper of a given paper weight and the voltage response to light passing through two sheets of paper of the same given paper weight is small, then the voltage responses could overlap due to imperfections in the paper, images that are on preprinted paper, misalignment between the emitter and phototransistor, and response variations between different phototransistors. This could cause false detections of double fed sheets.

Figure 3:
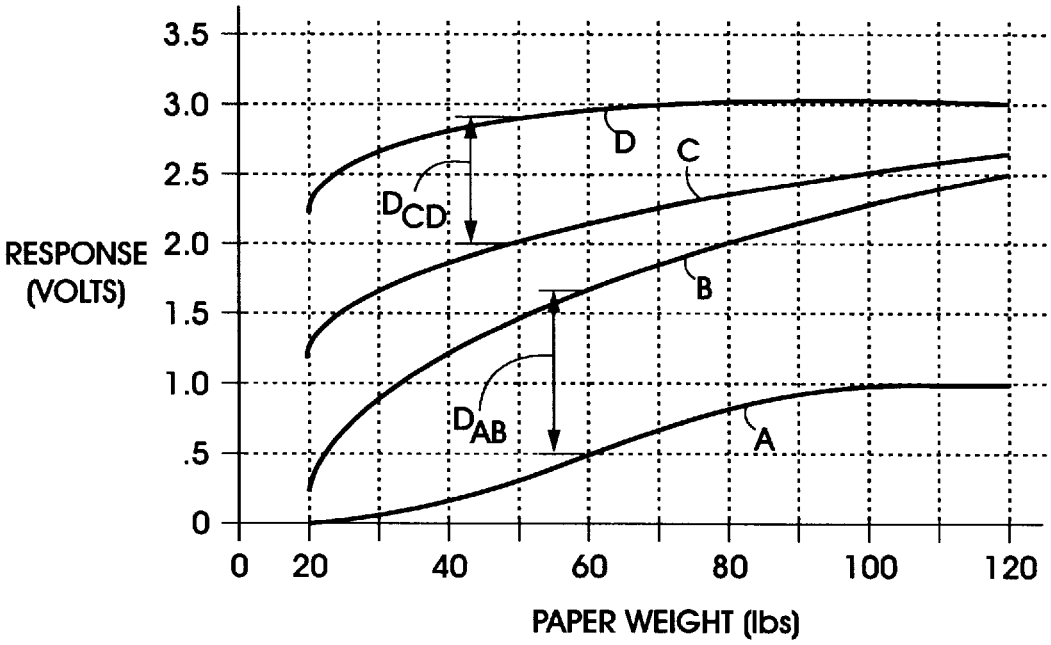
FIG. 3 is a graph of two sets of curves illustrating voltage response at the phototransistor for single sheets and double sheets depending upon the current supplied to the emitter and the paper weight of the single sheet measured and double sheet measured.

Referring to FIG. 3, there is shown a graph of four curves of a paper weight/voltage response relationship utilizing two different current values for the emitters 38, 88, 118 of the sensors 36, 86 and 116, respectively. The following discussion will be directed to the emitter 38 although it should be noted that the same applies to emitters 88 and 118. Curve A represents the voltage response (vertical axis) when a single sheet at different weights (horizontal axis) is passed across the sensor 36 and a current of 25 milliamps is supplied to the emitter 38 of sensor 36. Curve B represents the voltage response when two sheets, each of which is of the weight indicated along the horizontal axis for a single sheet, are passed across the sensor 36 and a current of 25 milliamps is supplied to the emitter 38 of sensor 36. Curve C represents the voltage response when a single sheet at different weights is passed across the sensor 36 and a current of 12 milliamps is supplied to the emitter 38 of sensor 36. Curve D represents the voltage response when two sheets, each of which is of the weight indicated along the horizontal axis for a single sheet, are passed across the 36 and a current of 12 milliamps is supplied to the emitter 38 of sensor 36.

From looking at curves A and B, one can see that the difference $D_{AB}$ between the voltage responses for a single sheet with a paper weight of 20 lbs. and two sheets, each of which is a paper weight of 20 lbs., is about 0.3 volt; the difference between the voltage responses for a single sheet with a paper weight of 30 lbs. and two sheets, each of which is a paper weight of 30 lbs., is about 0.75 volt; and the difference between the voltage responses for a single sheet with a paper weight of 40 lbs. and two sheets, each of which is a paper weight of 40 lbs., is about 1 volt. From inspection of the two curves A and B, one can see that the difference $D_{AB}$ between the voltage responses for a single sheet and two sheets continues to expand to 1.5 volts through a single sheet of a paper weight of 120 lbs. and two sheets, each of which is a paper weight of 120 lbs. It should be recalled that these two curves, A and B are generated using 25 milliamps at the emitter 38.

From looking at curves C and D, one can see that the difference $D_{CD}$ between the voltage responses for a single sheet with a paper weight of 20 lbs. and two sheets, each of which is a paper weight of 20 lbs., is about 1 volt; the difference between the voltage responses for a single sheet with a paper weight of 30 lbs. and two sheets, each of which is a paper weight of 30 lbs., is about 1 volt; and the difference between the voltage responses for a single sheet with a paper weight of 40 lbs. and two sheets, each of which is a paper weight of 40 lbs., is about 0.9 volt. From inspection of the two curves C and D, one can see that the difference $D_{CD}$ between the voltage responses for a single sheet and two sheets continues to decrease to about 0.4 volt through a single sheet of a paper weight of 120 lbs. and two sheets, each of which is a paper weight of 120 lbs. It should be recalled that these two curves, C and D are generated using 12 millamps at the emitter 38. For the purposes of the following discussion, curves A and B can be considered low voltage response curves and curves C and D can be considered high voltage response curves.

Single sheet paper weight of 20 lbs. is the most popular paper used and one can see that by obtaining a high voltage response for this weight of paper, it would be the most beneficial when compared to obtaining a low voltage response at this weight since there is an approximate 1 volt difference between a high voltage response (see curves C and D) for a single sheet of a 20 lb. weight and a high voltage response for two sheets, each of which is 20 lb. weight whereas the difference when there is a low voltage response (see curves A and B) is about 0.3 volt.

It can also be appreciated that when sheets of paper of a heavier weight are used, it is more beneficial to obtain a low voltage response, since for instance for a sheet of a paper weight of 60 lb. there is an approximate 1.25 volt difference between the low voltage response (see curves A and B) for a single sheet of a 60 lb. paper weight and a low voltage response for two sheets, each of which is a 60 lb. paper weight, whereas the difference when there is a high voltage response (see curves C and D) is about 0.75 volt. The advantage of a low voltage response for heavier sheets of paper is even greater when a sheet of a paper weight of 100 lb. or heavier weight is used since there is an approximate 1.5 volt difference between a low voltage response for a single sheet of a 100 lb. paper weight and a low voltage response for two sheets, each of which is 100 lb. paper weight, whereas the difference when there is a high voltage response (see curves C and D) is about 0.5 volt.

It follows that it would be most desirable to use a voltage response around 1.25 to 1.65 volts for sheets of a paper weight of less than about 30 lbs. and to use a voltage response of 0.25 volt for sheets of a paper weight that are above 30 lbs. in order to obtain maximum voltage differential between the voltage response to a single sheet of a given paper weight and the voltage response to two sheets of the same given paper weight. However, it is not desirable to use a voltage response for a single sheet until the voltage response level starts approaching about 0.4 volt. Otherwise the voltage response is too close to zero level to obtain significant confidence in the response level. Therefore, one might desire to use a voltage response in a range of about 0.4 volt to 1 volt at the sensors for sheets with a paper weight starting at between the range of 50 to 60 lbs. and above and use a voltage response in the range of about 1.25 to 2 volts at the sensors for sheets with a paper weight below the range of 50 to 60 lbs.

Therefore, it is preferable to have the difference between a voltage response at the phototransistor for a single sheet and a voltage response for two sheets, each of the same paper weight as the single sheet, fed through the sensor to be large enough throughout all paper weight ranges to obviate the possibility of voltage response overlap. This can be accomplished by providing a sensor which is capable of being in a first given voltage response condition for sensing sheets of a first given paper weight range and a second given voltage response condition for sensing sheets of a second paper weight range which is heavier than the first range. The voltage response conditions will be such that when the sensor is in the first given voltage response condition, the sensor will have a voltage response, when sensing a sheet of a given paper weight, which is higher than the voltage response when the sensor is in the second given voltage response condition and senses a sheet of the same paper weight.

Assume that a desirable characteristic of a sensor would be to have a sensor obtain a voltage response when sensing single sheets with a paper weight range up to and including 50 lbs. which would be more than the voltage response when sensing single sheets with a paper weight range above 50 lbs. One would then calibrate the sensor by picking out a voltage response that would be desired at a particular paper weight in each range and then adjust the current to the emitter to obtain that voltage response. For instance, a sheet of a paper weight of 20 lbs. would be passed through a sensor to obtain a desired voltage response of 1.25 volts. According to curve C in FIG. 3, the current that would be supplied to the emitter is 12 milliamps to obtain the voltage response of 1.25 volts. Depending upon the alignment between the emitter and the phototransistor and the response characteristics of the phototransistor, the 12 milliamps may or may not supply the desired 1.25 volts and the current may have to be adjusted accordingly to obtain such. The calibration can be performed manually.

After the sensor is calibrated for the sheet of 20 lb. paper weight, a sheet of a paper weight of 60 lbs. is passed through a sensor to obtain a desired voltage response of 0.5 volt. According to curve A in FIG. 3, the current that would be supplied to the emitter is 25 millamps to obtain the voltage response of 0.5 volt. Depending upon the alignment between the emitter and the phototransistor and the response characteristics of the phototransistor, the 25 milliamps may or may not supply the desired 0.5 volt and the current may have to be adjusted accordingly to obtain such.

Assuming that 12 milliamps and 25 milliamps satisfy the voltage response of the sensor to sense sheets of a paper weight of 20 lbs. and 60 lbs., respectively, then 12 milliamps would be supplied to the emitter when sheets with a paper weight range up to and including 50 lbs. are sensed and 25 milliamps would be supplied to the emitter when sheets with a paper weight range above 50 lbs. are sensed. This sets the sensor to be in a first voltage response condition (when 12 milliamps are supplied to the emitter) having a voltage response, when sensing a sheet of a given paper weight, which is higher than a voltage response when the sensor senses a sheet of the same paper weight, when the sensor is in a second voltage response condition (when 25 millamps is supplied to the emitter).

If a different voltage response was desired for a sheet of a paper weight of 20 lbs., such as 1 volt, then one can see from curves A and C in FIG. 3 that the current to be supplied to the emitter sensor to obtain such voltage response would fall between 12 and 25 milliamps. Similarly, if the voltage response was desired for a sheet of a paper weight of 60 lbs. was 0.75 volt, the current to be supplied to the emitter of the sensor to obtain such response would fall between 12 and 25 milliamps.

When using more than one sensor such as disclosed in this invention, it is necessary to calibrate each sensor in the same manner. A sheet of a 20 lb. paper weight will be passed through each sensor 36, 86, and 116 with the current being adjusted at the emitter of each sensor to obtain a voltage response of 1.25 volts and then the sheet of a 60 lb. paper weight will be passed only through each sensor 86, 116 with the current being adjusted at the emitter of each sensor 86 and 116 to obtain a voltage response of 0.5 volt. If the alignment of the emitter and phototransistor of each sensor is the same and the response characteristics of each phototransistor are the same, then a current of 12 milliamps supplied to the emitter of each sensor should produce a voltage response of 1.25 volts and a current of 25 millamps supplied to the emitter of each transducer should produce a voltage response of 0.5 volt. However, if the conditions at each sensor are not the same, then different current values may have to be supplied to each emitter to provide the given voltage response at a corresponding sensor for the same sheet.

Figure 4:
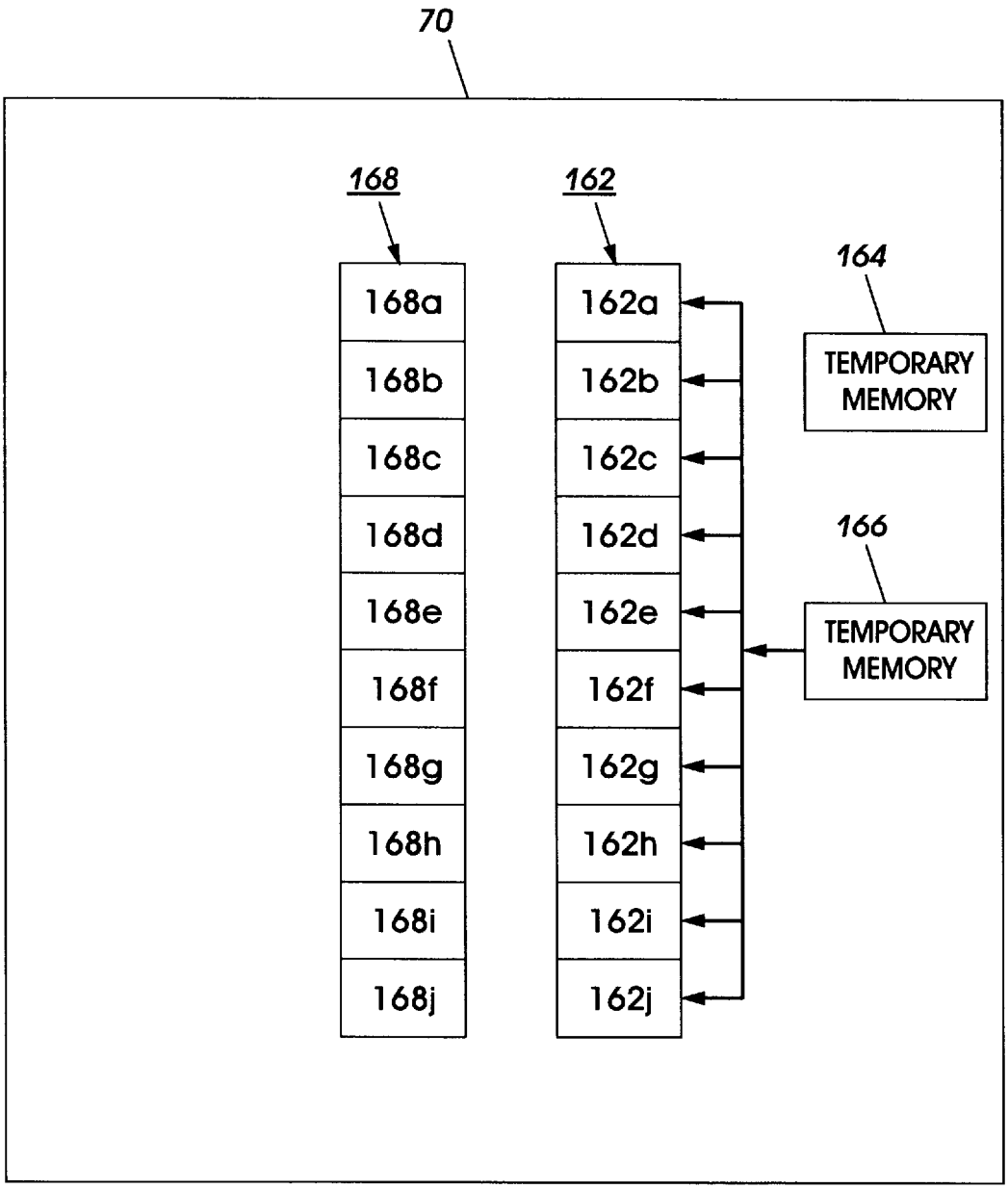
FIG. 4 is a block schematic diagram of a portion of a RAM memory of the schematic of FIG. 2.

The Ram section of the memory 70 is shown in FIG. 4. Temporary memory locations 162 are provided for storage of the thickness values sensed by the sensor 86 of all sheets. The number of locations 162 will be at least equal to the sheet capacity of the intermediate stacker 26. Ten locations, 162*a* through 162*j* are shown for illustrative purposes only. A temporary memory location 164 is provided for storage of the thickness values sensed by the preliminary inlet sensor 36. A temporary memory location 166 is provided for storage of the thickness values sensed by the outlet sensor 116. Each memory location contains a plurality of memory sites, depending upon the number of samplings taken during sensing of a sheet Temporary memory locations 168 are provided for storage of the current values to be supplied to the emitter 118 when each sheet is sensed by the sensor 116. The number of locations 168 will be at least equal to the sheet capacity of the intermediate stacker 26. Ten locations, 168*a* through 168*j* are shown for illustrative purposes only.

Using the above illustration and assuming that the paper weight ranges and the voltage response conditions are the same, but assume that a current value of 14, 12 and 15 milliamps are supplied to the emitters, 38, 88 and 118, respectively to obtain a voltage response at their corresponding sensors 36, 86 and 116 of 1.25 volts when sensing a sheet of a 20 lb. paper weight and that a current value of 25 and 28 milliamps are supplied to the emitters 88 and 118, respectively to obtain a voltage response at their corresponding sensors 88 and 118 of 0.5 volt when sensing a sheet of a 60 lb. paper weight, the system can be set up as follows: the CPU 48 is programmed to communicate to the I/O buffer 52 the value of 14 milliamps for the current to be supplied to the emitter 38 for sensing all sheets that are passed through the sensor 36 from each of the trays 10. The CPU is also programmed to supply a current of 12 milliamps to the emitter 88 for measuring the thickness of sheets that have a paper weight up to and including 50 lbs. and to supply a current of 25 milliamps to the emitter 88 for measuring the thickness of sheets that have a paper weight above 50 lbs.

The CPU is further programmed to supply a current of 15 milliamps to the emitter 118 for measuring the thickness of sheets that have a paper weight up to and including 50 lbs. and to supply a current of 28 milliamps to the emitter 118 for measuring the thickness of sheets that have a paper weight above 50 lbs.

A voltage response value which corresponds to a voltage response at the phototransistor 40 for a sheet of a 50 lb. paper weight when 14 milliamps is supplied to the emitter 38 is stored in the EPROM. The EPROM contains a program which compares the voltage response value of the sheet sensed by sensor 36 with the stored voltage response value. If the voltage response of the sheet is equal to or less than the stored value, the program will instruct the CPU 48 to in put a value of 12 milliamps to the buffer 72 and input 15 milliamps, to be supplied to the emitter 118 of sensor 116, in an appropriate memory location 168 for that sheet. If the voltage response of the sheet is above the stored value, the program will instruct the CPU 48 to input a value of 25 milliamps to the buffer 72 and input 28 milliamps, to be supplied to the emitter 118 of sensor 116, in an appropriate memory location 168 for that sheet.

The EPROM also contains a program for controlling measurement and storage of thickness values of the sheets 12 arriving at the sensors 36, 86, and 116 and for comparison of the thickness values for detecting a double sheet feed from the intermediate stacker 26.

The CPU 48 is programmed to keep track of the sheets as they are fed from a particular tray until after they pass through the outlet sensor 116 and place the sensed thickness values in the appropriate memory locations and compare the thickness values corresponding to the same sheet. The CPU 48 is also programmed to address the appropriate memory location 168 to obtain the appropriate current to be supplied to the emitter 118 and transmit the value of the current to the 10 buffer 72 prior to the time that each sheet is sensed by the outlet sensor 116.

In operation, a current value of 14 milliamps is constantly supplied to the emitter 38. When a sheet 12 is introduced into the sensor 36, there will be a sudden voltage change at the collector 43 which is sensed by the positive transition detector 50 which causes an interrupt through the control line 46 at CPU 48. The CPU 48 is programmed to only respond to the initial interrupt and ignore any subsequent interrupts until after the sheet of paper has left the sensor 36. In response to the initial interrupt, the CPU, in conjunction with the MMU 80, addresses the I/O buffer 52 which immediately resets the peak detector 44. The voltage at collector 43 can be sampled only once per sheet or a plurality of times as the sheet passes through the sensor. Sampling the sheet thickness once has a drawback if the sheet has an opaque portion or, if it is a preprinted form, has light and dark printing on it, since, if any of these are sensed, an incorrect reading of the thickness of a sheet will occur. Therefore it is desirable to sample the thickness of the sheet at more than one location. For example, the sheet can be sampled six times as the sheet passes through the sensor 36. Assuming that the sheet is 8½×11 inches and the 11 inch edge is the leading edge into the sensor 36, and the sheet passes across the sensor 36 at a speed of 65 inches per second, each sheet section sensed before sampling will be 1.4 inches and sampling will occur every 22 milliseconds.

The peak detector senses the voltage at collector 43 as the sheet passes between the emitter 38 and the phototransistor 40 with this voltage representing the thickness of the sheet. The voltage at the peak detector 44 is inputted to the A/D converter 60 in analogue form and this is converted to digital form by the A/D converter 60 and sent to the latch 56. The first sensing will be completed by a first sampling taken 22 milliseconds after entry of the sheet into the sensor 36. The latch will be set at 22 milliseconds to capture the peak voltage in peak detector 44 and the peak detector reset immediately thereafter for detecting the voltage over the next 1.4 inches of the sheet. Some time between the expiration of the first 22 milliseconds and the expiration of the next 22 milliseconds, the I/O buffer 52 will input the voltage information for the first sampling of the sheet to the temporary memory location 164. The same cycle is repeated until after the sixth 1.4 inch section is sampled. When a new sheet is introduced into the sensor 36, the sudden voltage change at the collector 43 is sensed by the positive transition detector 50 which causes an interrupt at the CPU 48 and the same cycle is repeated for the new sheet.

After the sixth 1.4 inch section of the sheet 12*a* is sampled while the sheet passes through sensor 36, the six sampled values of the sheet 12 are placed into memory location 164. This thickness or voltage response value is compared to the voltage response value stored in the EPROM to determine if the paper weight of the sheet is at, below or above 50 lbs. to select the appropriate current to be supplied to the emitter 88 for sensing the same sheet at input sensor 86. This can be achieved by comparing the sum of the six sensed values in memory location 164 with the sum of the six sensed values stored in the EPROM. If the sum of the voltage response of the sheet is equal to or less than the stored value, the paper weight of the sheet is at or below 50 lbs. If the sum of the voltage response of the sheet is above the stored value, the paper weight of the sheet is above 50 lbs. The CPU 48 will input the appropriate current selected, either 12 milliamps or 25 milliamps, to the buffer 72 which transmits the same to the current source 150 via the D/A converter 146 and the control line 152. The CPU 48 also inputs the appropriate current, either 15 or 28 milliamps in the appropriate memory location 168 to be associated with the sheet just sensed by sensor 36.

The same sheet 12 now enters the sensor 86 which has the appropriate current value supplied to it by the current source 150 and the sheet is sensed by the sensor 86 in the same manner as the sheet was sensed by sensor 36 with the voltage at collector 122 being sampled six times. The thickness value sensed by the sensor 86 is placed in an appropriate memory location 162.

The thickness value sensed by sensor 86 for each sheet will be placed into one of the memory locations 162 in accordance with a queue position in which it is introduced into the sensor 86. For instance, if a sheet 12 is the second sheet to be introduced into the sensor 86, then the thickness value sensed will be placed in memory location 162*b*. Also, the current value to be supplied to the emitter 118 to sense this sheet will be placed in memory location 168*b*. If a sheet is the fourth sheet introduced into the sensor 86, then the thickness value sensed will be placed in memory location 162*d* and the current value to be supplied to the emitter 118 to sense this sheet will be placed in memory location 168*d*. If a sheet is the seventh sheet introduced into the sensor 86, then the thickness value sensed will be placed in memory location 162*g* and the current value to be supplied to the emitter 118 to sense this sheet will be placed in memory location 168*g*.

When a sheet 12 is fed from the intermediate sheet stacker 26 and introduced into the outlet sensor 116, there will be a sudden voltage change at the collector 122 which is sensed by the positive transition detector 130 which causes an interrupt through the control line 128 at CPU 48. The CPU 48 is programmed to only respond to the initial interrupt and ignore any subsequent interrupts until after the sheet of paper has left the sensor 116. In response to the initial interrupt the CPU 48, in conjunction with the MMU 80, addresses the memory 168 to obtain the pertinent current value to be supplied to the emitter 118 for sensing the sheet when it passes through sensor 116. The current value is sent to the I/O buffer 77 which causes the current source 158 to supply that current value to the emitter 118. In response to the initial interrupt, the CPU 48 also, in conjunction with the MMU 80, addresses the I/O buffer 76 which immediately resets the peak detector 126. The voltage at collector 122 is sampled six times which is the same number that the voltage at collector 92 was sampled when the same sheet passed through sensor 86. The sheet passes through the outlet sensor 116 at approximately ½ the speed that the sheet passes through the inlet sensor 86. Therefore, each sheet section sensed before sampling will be 1.4 inches and sampling will occur ever 44 milliseconds.

The peak detector 126 senses the voltage at collector 80 as the sheet passes between the emitter 118 and the phototransistor 120 with this voltage representing the thickness of the sheet. The voltage at the peak detector 126 is inputted to the A/D converter 138 in analogue form and this is converted to digital form by the A/D converter 138 and sent to the latch 134. The first sensing will be completed by a first sampling taken 44 milliseconds after entry of the sheet into the sensor 116. The latch will be set at 44 milliseconds to capture the peak voltage in peak detector 126 and the peak detector reset immediately thereafter for detecting the voltage over the next 1.4 inches of the sheet. Some time between the expiration of the first 44 milliseconds and the expiration of the next 44 milliseconds, the I/O buffer 76 will input the voltage information for the first sampling of the sheet to temporary memory location 166. The same cycle is repeated until after the sixth 1.4 inch section is sampled.

After the sixth 1.4 inch section of a sheet is sampled while the sheet passes through the sensor 116 and which are stored in memory 166 are compared with the sum of the six sampled values of the sheet as it passed through the inlet sensor 86 which are located in the appropriate memory location 162. If the sums are within a chosen tolerance of each other, it will be assumed that only one sheet has passed through the outlet sensor 116 and normal operation of the printing system will continue. If the sum of the six sensed values by sensor 86, which is located in memory location 162, is less than the sum of the six sensed values by sensor 116, located in memory location 166 by more than a chosen tolerance, then such will indicate a greater sheet thickness for the subsequent sheet than the first sheet. Thus, it will be assumed that more than one sheet has passed through the sensor 116 and a signal will be sent by the CPU 48 over the control line 82 to the feeder controller 84 to immediately stop the sheet feeding system. A system operator can then remove the double fed sheets and reset the system to resume normal operation. Alternatively, a signal can cause the offending sheets to be sent to a purge tray at the printer without stopping the sheet feeding system.

The thickness values associated with a particular sheet in each of the memory locations 162*a*–162*j* and the current values associated with a particular sheet in each of the memory locations 168*a*–168*j* will stay in such memory location until the sheet associated with such memory locations passes through outlet sensor 116 and the thickness value comparison is made at which time the CPU 48 clears the memory locations associated with that sheet, including memory location 166.

In order to know which sheet is entering the intermediate stacker outlet sensor 116, a first in, first out system is set up. If a plurality of sheets are introduced into the intermediate stacker after passing through the sensor 86, the first sheet into the stacker will be the first sheet out of the stacker since the vacuum transport belt 28 is at the bottom of the stacker and feeds sheets to the outlet sensor 116 from the bottom of the stack of sheets in intermediate stacker 26.

In summary and as an example, a sheet 12 passes through sensor 36 and the thickness value sensed is placed into temporary memory location 164 and that value is compared with the value in the EPROM to determine if 12 milliamps or 25 milliamps should be supplied to the emitter 88 of the inlet sensor 86. Assume that it was determined that a current of 25 milliamps should be supplied to the emitter 88 of inlet sensor 86. The CPU 48 causes the thickness value in temporary memory location 164 to be erased and inputs the 25 milliamps value to buffer 72 which causes the current source to supply 25 milliamps to the emitter 88. Assuming that this particular sheet is the seventh sheet to pass through the sensor 36, the CPU 48 along with the MMU 80 will cause the current value of 28 milliamps to be supplied to the emitter 118 for sensing such sheet to be stored in memory location 168*g*.

As the sheet 12 passes through the inlet sensor 86, the emitter is supplied with 25 milliamps and the thickness value of the sheet is sensed and that value is placed into memory location 162*g*. The sheet passes into the intermediate stacker 26. When the sheet exits the intermediate stacker 26 and enters the outlet sensor 116, there is a sudden voltage change at the collector 122 which is sensed by the positive transition detector 130. There is an initial interrupt caused by positive transition detector 130 and in response thereto, the CPU 48 will address memory location 168*g* to obtain the 28 milliamp value and input that value to the I/O buffer 77 which causes the current source 158 to supply 28 milliamps to the emitter 118 of outlet sensor 116. The thickness value sensed by sensor 116 of sheet 12 is stored in temporary memory 166 and will be compared to the thickness value stored in memory location 162*g*. After the comparison is made, the CPU 48 causes the memory locations 162*g* and 168*g* and temporary memory location 166 to be cleared. If it is determined that only one sheet has passed through the outlet sensor 116, normal operation of the printing system will continue. If it is determined that more than one sheet has passed through the outlet sensor 116, a signal will be sent by the CPU 48 over the control line 82 to the feeder controller 84 to immediately stop the sheet feeding system. A system operator can then remove the double fed sheets and reset the system to resume normal operation. Alternatively, in response to the signal, the offending sheets can be sent to a purge tray at the printer without stopping the sheet feeding system.

When a new sheet is introduced into the outlet sensor 116, the sudden voltage change at the collector 122 is sensed by the positive transition detector 130 which causes an interrupt at CPU 48 and the same cycle is repeated for the new sheet.

It should be understood that the selection of 12 milliamps and 25 milliamps as the operating currents for the emitters and for generating the curves in FIG. 3 is for illustrative purposes only. Other magnitudes of current can be selected depending upon the desirable voltage response specifications of the system, the response characteristics between the emitter and phototransistor and other factors.

Figure 5:
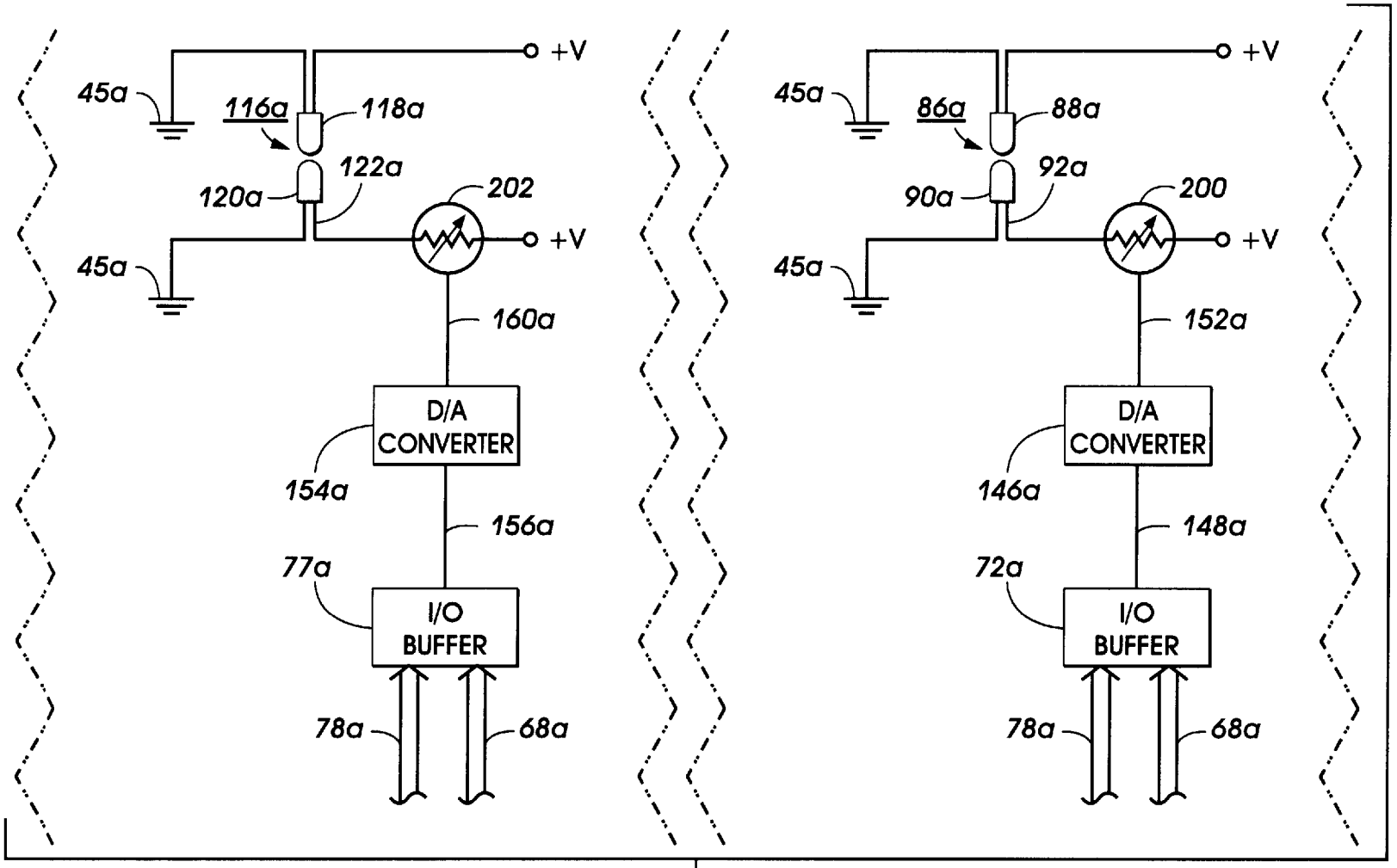
FIG. 5 is a modified block schematic diagram of the embodiment of FIGS. 1–4.

Rather than control the amount of current supplied to the emitter of a sensor to provide the desired voltage response at the sensor, resistance in a phototransistor collector circuit can be varied to provide the desired voltage response condition. A simplified schematic illustrating this principle is shown in FIG. 5. All elements that are the same as shown in the embodiment illustrated in FIG. 2 are represented by the same reference numerals, only with an "a" affixed thereto. The fixed resistors 91 and 121 of the schematic shown in embodiment of FIG. 2 are replaced by variable resistors 200 and 202, respectively. The sensor 36 still has a fixed resistor 41, although it should be understood that a variable resistor could be provided for the sensor 36. The resistance of resistors 200 and 202 can be varied by any well known circuit means. As stated previously, the voltage response at the collector of each sensor increases with an increase in paper weight since less current flows from each phototransistor 90*a* and 120*a* through their corresponding resistors 200 and 202. Since more current flows through the resistors 200 and 202 when lighter sheets are sensed by their sensors than when heavier sheets are sensed, the resistance must be decreased to increase the voltage response at the collector. Since less current flows through the resistors 200 and 202 when heavier sheets are sensed by their sensors than when lighter sheets are sensed, the resistance must be increased to decrease the voltage response at the collector.

Accordingly, in order to have a voltage response at a sensor which is higher, when the sensor is in the first condition and sensing a sheet of a given paper weight than it will have when in a second condition and sensing a sheet of the same paper weight, the resistance value of the resistor has to be higher when the sensor is in the first condition than the resistance value of the resistor when the sensor is in the second condition.

When calibrating the sensors to sense sheets in each range of paper weight values, a voltage response can be selected for a sheet of a paper weight of 20 lbs. and such sheet is passed through each sensor 86*a* and 116*a*. The resistance of resistors 200 and 202 will be adjusted to provide the desired voltage response at each sensor 86*a* and 116*a*. Then a voltage response can be selected for a sheet of a paper weight of 60 lbs. and such sheet is passed through each sensor. The resistance of resistors 200 and 202 will be adjusted to provide the desired voltage response at each sensor. If the alignment of the emitter and phototransistor of each sensor is the same and the response characteristics of each phototransistor are the same, then the same resistance value at the resistor of each sensor should provide the same desired voltage response when sensing the same sheet. However, if the conditions at each sensor are not the same, then there may have to be different resistance values at the resistor of each sensor to provide the same desired voltage response when sensing the same sheet. The calibrations can be performed manually.

The operation of the system described will be the same, only instead of current values being changed at the sensors 86 and 116, resistance values will be changed at the sensors 86*a* and 116*a*. For instance, the CPU 48 will be programmed to provide a first resistance value at the resistor 200 for measuring the thickness of sheets that have a paper weight up to and including 50 lbs. and to supply a second resistance value, which is higher than the first resistance value, at the resistor 200 for measuring the thickness of sheets that have a paper weight above 50 lbs. The CPU is further programmed to provide a third resistance value at the resistor 202 for measuring the thickness of sheets that have a paper weight up to and including 50 lbs. and to supply a fourth resistance value, which is higher than the third resistance value, at the resistor 202 for measuring the thickness of sheets that have a paper weight above 50 lbs.

Depending upon the conditions at each sensor, the first and third resistances may or may not be substantially equal and the third and fourth resistances may or may not be substantially equal. The I/O buffers 72*a* and 77*a* will be controlled to transmit resistance values to the variable resistors 200 and 202, respectively, instead of I/O buffers 72 and 77 transmitting current values in the previous embodiment. Memory locations 168 will be used to store the appropriate resistance values to be used for each sheet instead of storing the current values of the previous embodiment.

Instead of comparing sums of values, each value sampled of a sheet at the outlet sensor 116 can be compared with each corresponding value sampled for the same sheet at the inlet sensor 86. If a certain number of values match within a given tolerance, it will be assumed that only one sheet passed through the sensors. For instance, if four of the six sensed values match, it will be assumed that only one sheet passed through the sensor. In this case, the sum of the samplings at preliminary sensor 36 could still be used for comparison with the thickness value stored in the EPROM to determine the current value to be used at emitter 88. Obviously, other ways of comparing values can be used and the number of samplings can be changed to a particular situation desired. The comparison function can be conducted as a new sheet is fed from any tray into its respective sensor. This way, the system is not held up while a comparison is being made.

Figure 6:
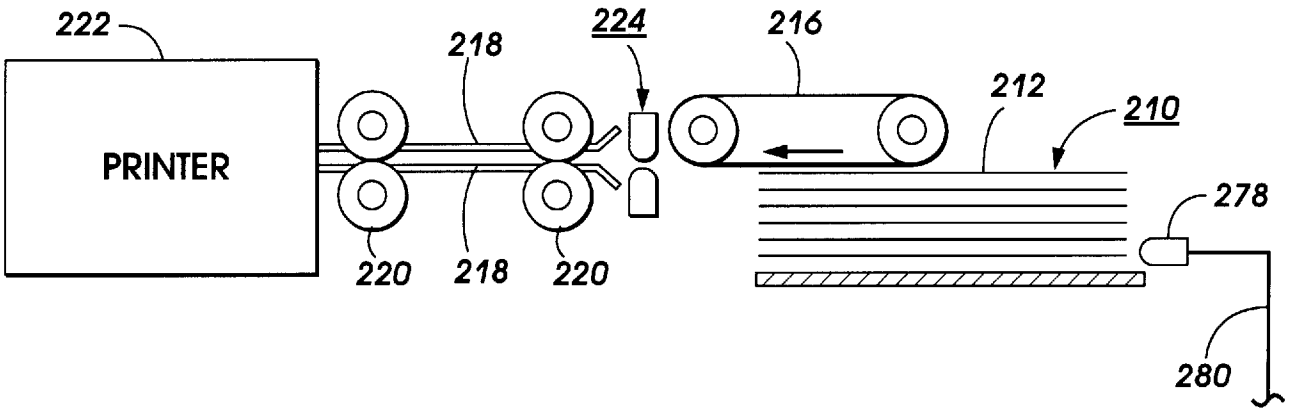
FIG. 6 is a schematic view of another embodiment employing this invention in a single tray printing system.

Referring to FIG. 6, there is shown another embodiment employing the invention of a misfeed detector with voltage response adjustment. A printing system comprising a feed tray 210, has a plurality of sheets 212 stacked therein. The sheets are all of the same thickness or paper weight. A vacuum sheet transport belt conveyor 216 transports a sheet to a guide 218 where a plurality of driven nip rolls 220 move a sheet through the guides from which the sheet enters a laser printer 222 where an image is transferred to each sheet. Sensor 224 is located between the tray 210 and the guide 218 for sensing the thickness or paper weight of the sheets 212 as they are fed from the tray 210.

Figure 7:
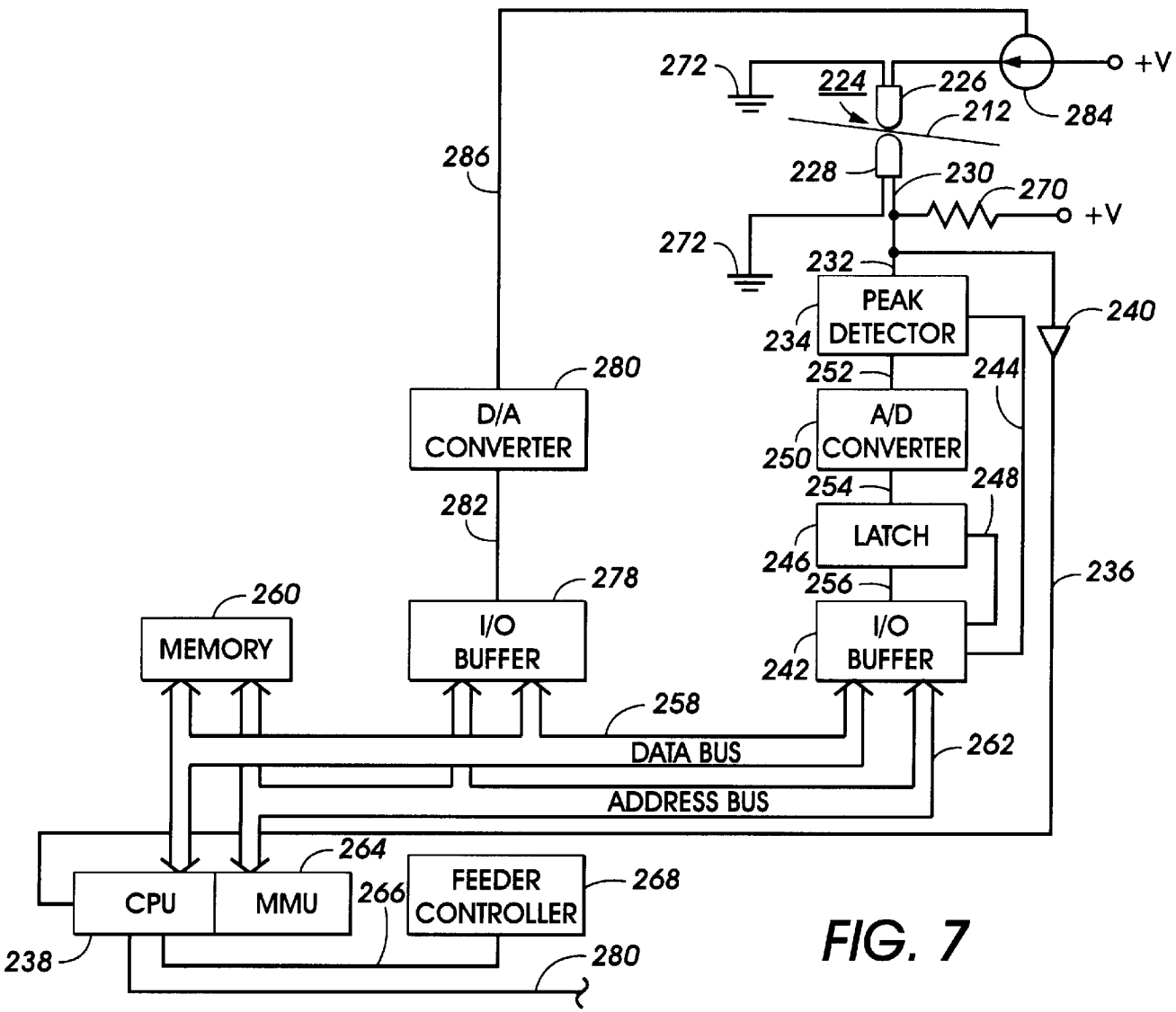
FIG. 7 is a block schematic diagram for the single tray printing system illustrated in FIG. 6.

Referring to FIG. 7, there is shown a schematic of a sheet thickness sensing arrangement for tray 210. The inlet sensor 224 comprises an infrared emitter 226 and a phototransistor 228. The collector 230 of the phototransistor 228 is connected through a control line 232 to a peak detector 234 and through control line 236 to a CPU (central processing unit) 238. A positive transition detector 240 is located in control line 236 between the phototransistor 228 and the CPU 238 and detects sudden voltage changes at the collector 230. The peak detector 234 detects a peak voltage at collector 230 and is connected to an I/O (Input/output) buffer 242 through a control line 244 to allow the CPU to reset the peak detector to zero. A latch 246 is connected to the I/O buffer 242 through a control line 248 to allow the CPU to implement a data latch function. An A/D (analog/digital) converter 250 is connected to the peak detector 234 by line 252 and to the latch 246 by a data line 254. A data line 256 connects the latch 246 to the I/O buffer 242. A data bus 258 links the CPU 238 with the I/O buffer 242, an I/O buffer 278 and memory 260. The memory 260 is a two part memory having a RAM and an EPROM. An address bus 262 links a MMU (memory management unit 264 with the I/O buffers 242, 278 and the memory 260. The CPU 238 is connected through a control line 266 to a feeder controller 268 for controlling feeding of the sheets from the tray 210.

The I/O buffer 278 is connected to a digital to analogue (D/A) converter 280 by a data line 282. The D/A converter 280 is connected to a current source 284 for the emitter 226 by a current control line 286. The CPU 238 addresses the I/O buffer 278 by the address bus 262 and sends a value of current to the buffer 278 by data bus 258. The buffer 278 sends that value to the D/A converter 280 over the data line 282 and that value is converted by the D/A converter 280 to an analogue signal that is transmitted to the current source 284 by current control line 286 to supply a given current to the emitter 226.

The Ram section of the memory 260 is shown in FIG. 7. There is a memory location 274 for storing the voltage response value at the phototransistor 228 which represents the thickness value of the sheets in tray 210. The sensed thickness value of the first sheet fed from the tray 210 is put into this location. There is also a temporary memory location 276 for storing the thickness values sensed by sensor 224 of all other sheets fed from the tray 210.

Assuming that the sensor 224 requires a current of 12 milliamps supplied to the emitter 226 for the proper voltage response for sheets with a paper weight up to and including 50 lbs. and 25 milliamps supplied to the emitter 226 for the proper voltage response for sheets with a paper weight above 50 lbs., the system can be set up as follows: The CPU 238 is programmed to communicate to the I/O buffer 278 the value of 12 milliamps for the initial current to be supplied to the emitter 226 for the first sheet of paper 212 that is passed through the sensor 224. The CPU 238 is also programmed to supply a current of 12 milliamps to the emitter 226 for measuring the thickness of sheets that have a paper weight up to and including 50 lbs. and to supply a current of 25 milliamps to the emitter 226 for measuring the thickness of sheets that have a paper weight above 50 lbs. A voltage response value which corresponds to a voltage response at the phototransistor 228 for a sheet of a 50 lb. paper weight when 12 milliamps is supplied to the emitter 226 is stored in the EPROM. The EPROM contains a program which compares the voltage response value of the first sheet sensed from tray 210 with the stored voltage response value. If the voltage response of the first sheet is equal to or less than the stored value, the program will instruct the CPU 238 to input a value of 12 milliamps to the buffer 278 and if the voltage response of the first sheet is above the stored value, the program will instruct the CPU to input a value of 25 milliamps to the buffer 278.

The EPROM also contains a program for controlling measurement and storage of thickness values of the sheets 212 arriving at the sensor 224 from the tray 210 and for comparison of the thickness values for detecting a double sheet feed from the tray 210.

The CPU 238 is programmed to keep track of the sheets as they are fed from the tray 210 until after they pass through the sensor 224 and place the sensed thickness values in memory locations 274 and 276 and compare the values in such memory locations.

Referring to FIG. 6, the tray 210 has a sensor 278 connected thereto for sensing when the tray has been lowered for refilling. The sensor 278 is communicated to the CPU 238 by a control line 280. The sensor may be a contact switch, a push button switch or any other well known sensing device. When the tray 210 is lowered, the sensor causes an interrupt through the control line at the CPU 238. The CPU 238 is programmed to respond to the interrupt to clear the memory location 274 and start the program for placing in memory location 274 the thickness value of the first sheet sensed that is fed from tray 210 after it is reloaded and to clear the I/O buffer 278 and send the value of the initial current of 12 milliamps to the 110 buffer 278 which is transmitted to the current source 284 to supply the emitter 226 with the initial current of 12 milliamps for measuring the thickness value of the first sheet sensed that is fed from tray 210 after it is reloaded.

In operation, the CPU 238 is programmed to transmit to the I/O buffer 278 the initial current value (12 milliamps) which is then transmitted to the current source 284 to supply 12 milliamps to the emitter 226. When a first sheet 212 is fed from tray 210 and introduced into the sensor 224, there will be a sudden voltage change at the collector 230 which is sensed by the positive transition detector 240 which causes an interrupt through the control line 236 at CPU 238. The CPU is programmed to only respond to the initial interrupt and ignore any subsequent interrupts until after the sheet of paper has left the sensor 224. In response to the initial interrupt, the CPU, in conjunction with the MMU 264, addresses the I/O buffer 242 which immediately resets the peak detector 234. As in the previous embodiment, the voltage at collector 230 is sampled six times.

The peak detector senses the voltage at collector 230 as the sheet passes between the emitter 226 and the phototransistor 228 with this voltage representing the thickness of the sheet. The voltage at the peak detector 234 is inputted to the A/D converter 250 in analog form and this is converted to digital form by the A/D converter 250 and sent to the latch 246. The I/O buffer 242 will send the voltage information of the sheet to the memory 260. When a new sheet is introduced into the sensor 224, the sudden voltage change at the collector 230 is sensed by the positive transition detector 240 which causes an interrupt at the CPU 238 and the same cycle is repeated for the new sheet the voltage response value stored in the EPROM to determine if the paper weight of the sheet is at, below or above 50 lbs. to select the appropriate current to be supplied to the emitter 26 for sensing subsequent sheets.

When the appropriate current value is selected, the CPU 238 is programmed to respond to such selection and input to the I/O buffer 278 the current value to be supplied to the emitter 226 for sensing subsequent sheets fed from tray 210. If the current to be supplied to the emitter for sensing subsequent sheets is 12 milliamps, then the thickness value which was placed in memory location 274 will stay in that location as the thickness value associated with all of the remaining sheets in tray 210. If the current to be supplied to the emitter for subsequent sheets is 25 milliamps, then the CPU 238 is programmed to clear the thickness value placed in memory location 274 and place the thickness value of the next sheet sensed by the sensor 224 in memory location 274.

The thickness value sensed for all subsequent sheets fed from tray 210 will be compared to the thickness value in memory location 274. If the thickness values are within a chosen tolerance of each other, it will be assumed that only one sheet has passed through the sensor 224 and normal operation of the printing system will continue. If the thickness value, which is located in memory location 274, for the first sheet is less than the thickness value, located in memory location 276, of a subsequent sheet fed from tray 210 by more than a chosen tolerance, then such will indicate a greater sheet thickness for the subsequent sheet than the first sheet. Thus, it will be assumed that more than one sheet has passed through the sensor 224 and a signal will be sent by the CPU 238 over the control line 266 to the feeder controller 268 to immediately stop the sheet feeding system.

The thickness value in memory location 274 will stay in memory location 274 until the tray 210 is lowered to refill the tray at which time the sensor 278 will cause an interrupt through control line 280 at the CPU 238 and the current thickness value is cleared from memory location 274. The thickness value sensed by sensor 224 of the first sheet fed from the tray 210, after the tray 210 has been refilled and after the memory location 274 has been cleared, will be placed into the memory location 274 as the new thickness value for all of the remaining new sheets 212 loaded onto tray 210. The current value for emitter 226 will stay in I/O buffer 278 until the tray 210 is lowered to refill the tray at which time the CPU 238, in response to the interrupt through control line 280, will clear the value from I/O buffer 278 and communicate the value of the initial amount of current (12 milliamps) to the I/O buffer which results in 12 milliamps being supplied to the emitter 226 for sensing the first sheet fed from the tray 210 after it has been refilled.

When a subsequent sheet 212 is fed from the tray 210, it is sensed by sensor 224 in the same manner as the first sheet was and after the sixth 1.4 inch section of a sheet 212 is sampled while the sheet passes through sensor 224, the six sampled values of the sheet are temporarily placed into memory location 276 and those values are compared with the six sampled values of the first sheet from the tray 210 that are in memory location 274.

Figure 8:
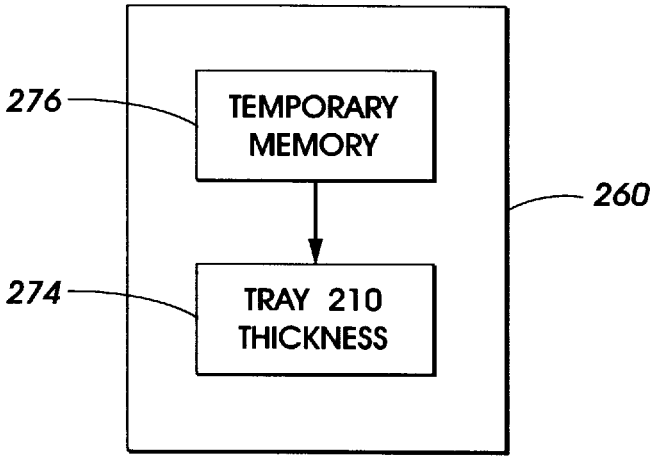
FIG. 8 is a block schematic diagram of a portion of a RAM memory of the schematic of FIG. 7.

The system of FIGS. 6–8 is based upon assuming that the first and second sheets (the thickness value of which is relied upon as representative of the thickness value for the remaining sheets from the tray 210) from tray 210 are truly single sheets and are not double sheets. This system could be modified to detect double sheets being fed as such a first or second single sheet from tray 210. For instance, if such first or second sheet fed from the tray 210 is a double fed sheet, a subsequent sheet fed from the tray will be sensed to have a lower voltage response beyond a given tolerance than the first or second sheet indicating the first or second sheet was a double fed sheet. The system will be stopped, the double fed sheets removed and the first or second fed sheet sensing reinitiated.

Rather than control the amount of current supplied to the emitter 226 of the sensor 224 to provide the desired voltage response at the sensor, resistance in a phototransistor collector circuit can be varied to provide the desired voltage response condition in the same manner as described for the embodiment of FIGS. 1–5 and disclosed specifically in FIG. 5.

In following the main principle of this invention, more than two ranges of paper weights can be selected. A different voltage response condition for a sensor can be set for each of the paper weight ranges as long as the sensor, when in a voltage response condition for sensing sheets from a range that encompasses sheets that are heavier than the sheets in another range, will have a voltage response which is lower than when the same sensor senses a sheet of the same paper weight, when the sensor is in a given voltage response condition for sensing sheets in another range.

The system and the electronic components thereof have been described in general. It should be realized that well known programming techniques and off-the-shelf hardware are all that is required to achieve the principles of this invention. Thus someone with ordinary skill in the art will be able to construct the system described.

I claim:

1. In a sheet transport system comprising:

a. a sensor for sensing a thickness or paper weight value of each sheet passing therethrough, b. said sensor comprising an emitter and a phototransistor being so constructed and arranged to receive sheets therebetween, c. said emitter emitting light rays towards said phototransistor, d. said sensor having a voltage response in accordance with the amount of light sensed by said phototransistor, e. condition changing means operably connected to said sensor for changing the conditions of voltage response of said sensor, f. said conditions of voltage response being at least one condition for sensing sheets of a first given range of sheet thickness or paper weight value and a second condition for sensing sheets of a second given range of sheets that are thicker or heavier value than said first given range, g. said sensor having a voltage response when in said one condition that is higher for a sheet of a given thickness or paper weight value than the voltage response for a sheet of the same given thickness or paper weight value when said sensor is in said second condition, and h. said condition changing means being responsive to a signal indicating a thickness or paperweight value of a sheet to be received by said sensor to set the condition of voltage response for said sensor in accordance with the given range of thickness or paper weight value corresponding to the thickness or paper weight value of the sheet to be received.

2. In a sheet transport system of claim 1 further comprising means for storing in memory the thickness or paper weight value sensed by said sensor.

3. In a sheet transport system of claim 1 further comprising means for storing in memory a thickness or paper weight value associated with a sheet prior to said sensor sensing the same sheet, and means for comparing the thickness or paper weight value sensed by said sensor of a sheet with the thickness or paper weight value in memory associated with the same sheet and generating a signal indicating a misfeed if the values differ by a predetermined amount.

4. In a sheet transport system of claim 1 further comprising:

a. a second sensor for sensing thickness or paper weight of sheets passing therethrough, b. said second sensor comprising an emitter and a phototransistor being so constructed and arranged to receive sheets therebetween, c. said second sensor emitter emitting light rays towards said second sensor phototransistor, d. said second sensor having a voltage response in accordance with the amount of light sensed by said phototransistor, e. second condition changing means operably connected to said second sensor for changing the conditions of voltage response of said second sensor, f. said conditions of voltage response for said second sensor being at least said one condition for sensing sheets of said first given range of sheet thickness or paper weight value and said second condition for sensing sheets of said second given range of sheets that are thicker or heavier value than said first given range, g. said second condition changing means for said second sensor setting the condition of voltage response for said second sensor, when sensing the thickness or paper weight value of a sheet to be sensed by said second sensor, to be the same condition as set for said first named sensor when the same sheet was sensed by said first named sensor, and h. means for comparing the thickness or paper weight value sensed at said first named sensor with the thickness or paper weight value sensed at said second sensor of the same sheet and generating a signal indicating a misfeed if the values differ by a predetermined amount.

5. In a sheet transport system of claim 4 wherein:

a. said condition changing means for each of said first named sensor and said second sensor comprises means for changing a current supplied to each of said emitters with a first given current being supplied to said emitter of said first named sensor when said first named sensor is in said one condition and a second given current, which is greater than the first given current, being supplied to said emitter of said first named sensor when said first named sensor is in said second condition and with a third given current being supplied to said emitter of said second sensor when said second sensor is in said one condition and a fourth given current, which is greater than the third given current, being supplied to said emitter of said second sensor when said second sensor is in said second condition, and b. the voltage response at each said sensor for sensing a given sheet is substantially the same when the first given current is supplied to said emitter of said first named sensor and the third given current is supplied to said emitter of said second sensor and the voltage response at each said sensor for sensing a given sheet is substantially the same when the second given current is supplied to said emitter of said first named sensor and the fourth given current is supplied to said emitter of said second sensor.

6. In a sheet transport system of claim 5 wherein the first and third given current values are different and the second and fourth given current values are different.

7. In a sheet transport system of claim 5 wherein the first and third given current values are substantially equal and the second and fourth given current values are substantially equal.

8. In a sheet transport system of claim 4 further comprising:

a. each said phototransistor having a collector, b. a voltage source, c. electrical resistance means for said first named sensor operably connected to said voltage source and said collector of said first named sensor and electrical resistance means for said second sensor operably connected to said voltage source and said collector of said second sensor, and d. said condition changing means for said first named sensor comprising means for changing the resistance value of said electrical resistance means for said first named sensor with a first given resistance value being supplied by said electrical resistance means for said first named sensor when said first named sensor is in said one condition and a second given resistance value, which is greater than the first given resistance value, being supplied by said electrical resistance means for said first named sensor when said first named sensor is in said second condition, e. said condition changing means for said second sensor comprising means for changing the resistance value of said electrical resistance means for said second sensor with a third given resistance value being supplied by said electrical resistance means for said second sensor when said second sensor is in said one condition and a fourth given resistance value, which is greater than the third given resistance value, being supplied by said electrical resistance means for said second sensor when said second sensor is in said second condition, and f. the voltage response at each said sensor for sensing a given sheet is substantially the same when the first given resistance value is supplied to said first named sensor and the third given resistance value is supplied to said second sensor and the voltage response at each said sensor for sensing a given sheet is substantially the same when the second given resistance value is supplied to said first named sensor and the fourth given resistance value is supplied to said second sensor.

9. In a sheet transport system of claim 8 wherein the first and third given resistance values are different and the second and fourth given resistance values are different.

10. In a sheet transport system of claim 8 wherein the first and third given resistance values are substantially equal and the second and fourth given resistance values are substantially equal.

11. In a sheet transport system of claim 1 wherein said condition changing means comprises means for changing a current supplied to said emitter with a first given current being supplied to said emitter when said sensor is in said one condition and a second given current, which is greater than the first given current, being supplied to said emitter when said sensor is in said second condition.

12. In a sheet transport system of claim 1 further comprising:

a. said phototransistor having a collector, b. a voltage source, c. electrical resistance means operably connected to said voltage source and said collector, and d. said condition changing means comprising means for changing the resistance value of said electrical resistance means with a first given resistance value being supplied by said electrical resistance means when said sensor is in said one condition and a second given resistance value, which is greater than the first given resistance value, being supplied by said electrical resistance means when said sensor is in said second condition.

13. In a sheet transport system comprising:

a. a support tray for supporting a stack of sheets, b. a preliminary sensor being located to sense a thickness or paper weight value of each sheet passing therethrough, c. an inlet sensor being located between said preliminary sensor and said support tray and arranged to receive a sheet from said preliminary sensor to sense a thickness or paper weight value of each sheet coming from said preliminary sensor, d. an outlet sensor being located to sense the thickness or paper weight value of a sheet discharged from said tray, e. each said inlet sensor and said outlet sensor comprising an emitter and a phototransistor being so constructed and arranged to receive sheets therebetween, f. each said emitter emitting rays towards its respective said phototransistor, g. each said sensor having a voltage response in accordance with the amount of rays sensed by said phototransistor, h. condition changing means operably connected to said inlet sensor and condition changing means operably connected to said outlet sensor for changing the conditions of voltage response of corresponding said sensors, i. said conditions of voltage response being at least one condition for sensing sheets of a first given range of sheet thickness or paper weight and a second condition for sensing sheets of a second given range of sheets that are thicker or heavier than said first given range, j. said inlet sensor and said outlet sensor each having a voltage response when in said one condition that is higher for a sheet of a given thickness or paper weight than the voltage response for a sheet of the same given thickness or paper weight when each of said inlet sensor and said outlet sensor is in said second condition, k. said condition changing means for said inlet sensor being responsive to the thickness or paper weight value sensed by said preliminary sensor of a sheet to set the condition of voltage response for said inlet sensor, when sensing the same sheet, in accordance with the given range of thickness or paper weight corresponding to the thickness or paper weight value sensed by said preliminary sensor of the same sheet, and l. said condition changing means for said outlet sensor setting the condition of voltage response for said outlet sensor, when sensing the thickness or paper weight value of a sheet being discharged from said tray, to be the same condition as set for said inlet sensor when the same sheet was sensed by said inlet sensor, and m. means for comparing the thickness or paper weight value sensed at the inlet sensor with the thickness or paper weight value sensed at the outlet sensor of the same sheet and generating a signal indicating a misfeed if the values differ by a predetermined amount.

14. In a sheet transport system of claim 13 wherein:

a. said condition changing means for each of said inlet sensor and said outlet sensor comprises means for changing a current supplied to each of said emitters with a first given current being supplied to said emitter of said inlet sensor when said inlet sensor is in said one condition and a second given current, which is greater than the first given current, being supplied to said emitter of said inlet sensor when said first named sensor is in said second condition and with a third given current being supplied to said emitter of said outlet sensor when said second sensor is in said one condition and a fourth given current, which is greater than the third given current, being supplied to said emitter of said outlet sensor when said second sensor is in said second condition, and b. the voltage response at each said sensor for sensing a given sheet is substantially the same when the first given current is supplied to said emitter of said inlet sensor and the third given current is supplied to said emitter of said outlet sensor and the voltage response at each said sensor for sensing a given sheet is substantially the same when the second given current is supplied to said emitter of said inlet sensor and the fourth given current is supplied to said emitter of said outlet sensor.

15. In a sheet transport system of claim 13 further comprising:

a. each said phototransistor having a collector, b. a voltage source, c. inlet sensor resistance means operably connected to said voltage source and said collector of said inlet sensor and outlet sensor electrical resistance means operably connected to said voltage source and said collector of said outlet sensor, and d. said condition changing means for said inlet sensor comprising means for changing the resistance value of said electrical resistance means for said inlet sensor with a first given resistance value being supplied by said electrical resistance means for said inlet sensor when said inlet sensor is in said one condition and a second given resistance value, which is greater than the first given resistance value, being supplied by said electrical resistance means for said inlet sensor when said inlet sensor is in said second condition, e. said condition changing means for said outlet sensor comprising means for changing the resistance value of said electrical resistance means for said outlet sensor with a third given resistance value being supplied by said electrical resistance means for said outlet sensor when said outlet sensor is in said one condition and a fourth given resistance value, which is greater than the third given resistance value, being supplied by said electrical resistance means for said outlet sensor when said outlet sensor is in said second condition, and f. the voltage response at each said sensor for sensing a given sheet is substantially the same when the first given resistance value is supplied to said inlet sensor and the third given resistance value is supplied to said outlet sensor and the voltage response at each said sensor for sensing a given sheet is substantially the same when the second given resistance value is supplied to said inlet sensor and the fourth given resistance value is supplied to said outlet sensor.

16. In a sheet transport system of claim 13 further comprising:

a. tracking means for keeping track of a sheet from at least when it passes through said preliminary sensor until the thickness or paper weight value sensed at said inlet sensor and the thickness or paper weight value sensed at said outlet sensor are compared, b. said tracking means further being so constructed and arranged to instruct said condition changing means for said outlet sensor to set the condition of voltage response for said outlet sensor when sensing the thickness or paper weight value of a sheet being discharged from said tray to be the same condition as set for said inlet sensor when the same sheet was sensed for thickness or paper weight value by said inlet sensor.

17. In a sheet transport system comprising:

a. at least two trays of sheets stacked thereon with the sheets on one tray being of a different thickness than the sheets on the other tray, b. an intermediate tray for receiving sheets from said at least two trays, c. a preliminary sensor being located to sense a thickness or paper weight value of each sheet discharged from said at least two trays, d. an inlet sensor being located between said preliminary sensor and said support tray and arranged to sense a thickness or paper weight value of each sheet coming from said preliminary sensor, e. an outlet sensor for sensing a thickness or paper weight value of each sheet discharged from said intermediate tray, f. each said inlet sensor and said outlet sensor comprising an emitter and a phototransistor being so constructed and arranged to receive sheets therebetween, i. each said emitter emitting rays towards its respective said phototransistor, j. each said sensor having a voltage response in accordance with the amount of rays sensed by said phototransistor, k. condition changing means operably connected to said inlet sensor and condition changing means operably connected to said outlet sensor for changing the conditions of voltage response of corresponding said sensors, l. said conditions of voltage response being at least one condition for sensing sheets of a first given range of sheet thickness or paper weight and a second condition for sensing sheets of a second given range of sheets that are thicker or heavier than said first given range, m. said inlet sensor and said outlet sensor each having a voltage response when in said one condition that is higher for a sheet of a given thickness or paper weight than the voltage response for a sheet of the same given thickness or paper weight when each of said inlet sensor and said outlet sensor is in said second condition, n. said condition changing means for said inlet sensor being responsive to the thickness or paper weight value sensed by said preliminary sensor of a sheet to set the condition of voltage response for said inlet sensor, when sensing the same sheet, in accordance with the given range of thickness or paper weight corresponding to the thickness or paper weight value sensed by said preliminary sensor of the same sheet, and o. said condition changing means for said outlet sensor setting the condition of voltage response for said outlet sensor when sensing the thickness or paper weight value of a sheet being discharged from said intermediate tray to be the same condition as set for said inlet sensor when the same sheet was sensed by said inlet sensor, and p. means for comparing the thickness or paper weight value sensed at the inlet sensor with the thickness or paper weight value sensed at the outlet sensor of the same sheet and generating a signal indicating a misfeed if the values differ by a predetermined amount.

18. In a sheet transport system of claim 17 wherein:

a. said condition changing means for each of said inlet sensor and said outlet sensor comprises means for changing a current supplied to each of said emitters with a first given current being supplied to said emitter of said inlet sensor when said inlet sensor is in said one condition and a second given current, which is greater than the first given current, being supplied to said emitter of said inlet sensor when said first named sensor is in said second condition and with a third given current being supplied to said emitter of said outlet sensor when said second sensor is in said one condition and a fourth given current, which is greater than the third given current, being supplied to said emitter of said outlet sensor when said second sensor is in said second condition, and b. the voltage response at each said sensor for sensing a given sheet is substantially the same when the first given current is supplied to said emitter of said inlet sensor and the third given current is supplied to said emitter of said outlet sensor and the voltage response at each said sensor for sensing a given sheet is substantially the same when the second given current is supplied to said emitter of said inlet sensor and the fourth given current is supplied to said emitter of said outlet sensor.

19. In a sheet transport system of claim 17 further comprising:

a. each said phototransistor having a collector, b. a voltage source, c. inlet sensor resistance means operably connected to said voltage source and said collector of said inlet sensor and outlet sensor electrical resistance means operably connected to said voltage source and said collector of said outlet sensor, and d. said condition changing means for said inlet sensor comprising means for changing the resistance value of said electrical resistance means for said inlet sensor with a first given resistance value being supplied by said electrical resistance means for said inlet sensor when said inlet sensor is in said one condition and a second given resistance value, which is greater than the first given resistance value, being supplied by said electrical resistance means for said inlet sensor when said inlet sensor is in said second condition, e. said condition changing means for said outlet sensor comprising means for changing the resistance value of said electrical resistance means for said outlet sensor with a third given resistance value being supplied by said electrical resistance means for said outlet sensor when said outlet sensor is in said one condition and a fourth given resistance value, which is greater than the third given resistance value, being supplied by said electrical resistance means for said outlet sensor when said outlet sensor is in said second condition, and f. the voltage response at each said sensor for sensing a given sheet is substantially the same when the first given resistance value is supplied to said inlet sensor and the third given resistance value is supplied to said outlet sensor and the voltage response at each said sensor for sensing a given sheet is substantially the same when the second given resistance value is supplied to said inlet sensor and the fourth given resistance is supplied to said outlet sensor.

20. In a sheet transport system of claim 17 further comprising:

a. tracking means for keeping track of a sheet from at least when it passes through said preliminary sensor until the thickness or paper weight value sensed at said inlet sensor and the thickness or paper weight value sensed at said outlet sensor are compared, b. said tracking means further being so constructed and arranged to instruct said condition changing means for said outlet sensor to set the condition of voltage response for said outlet sensor when sensing the thickness or paper weight value of a sheet being discharged from said tray to be the same condition as set for said inlet sensor when the same sheet was sensed by said inlet sensor.

* * * * *